United States Patent [19]

Lang

[11] Patent Number: 4,553,847

[45] Date of Patent: Nov. 19, 1985

[54] PACKAGING QUALITY CONTROL METHOD AND APPARATUS

[75] Inventor: Günter Lang, Zainingen, Fed. Rep. of Germany

[73] Assignee: Maschinenfabrik Alfred Schmermund GmbH & Co., Gevelsberg, Fed. Rep. of Germany

[21] Appl. No.: 444,079

[22] Filed: Nov. 24, 1982

[30] Foreign Application Priority Data

Nov. 24, 1981 [DE] Fed. Rep. of Germany ..... 3146506

[51] Int. Cl.[4] ..... G01N 21/55

[52] U.S. Cl. ..... 356/445; 250/223 R; 209/536; 356/448

[58] Field of Search ..... 356/237, 445, 448; 250/222.1, 223 R, 574; 356/307; 209/535, 536, 546

[56] References Cited

U.S. PATENT DOCUMENTS

| | | | |
|---|---|---|---|
| 3,473,037 | 10/1969 | Schmermund | 250/223 R |
| 3,689,158 | 9/1972 | Shifrin | 356/307 X |
| 3,818,223 | 6/1974 | Gibson et al. | 356/237 X |
| 4,158,505 | 6/1979 | Mathisen et al. | 356/325 X |
| 4,266,674 | 5/1981 | Bell et al. | 250/223 R X |
| 4,267,444 | 5/1981 | Bald | 209/536 X |
| 4,374,329 | 2/1983 | Schoenfelder et al. | 250/574 |
| 4,377,743 | 3/1983 | Bolt et al. | 250/223 R |

*Primary Examiner*—Vincent P. McGraw
*Assistant Examiner*—S. A. Turner

[57] ABSTRACT

The quality of a product, for example the degree of filling of cigarette papers, is non-destructively tested using reflectivity measurement. Compensation is provided for the effects of stray light in the measuring zone and the signals commensurate with the measurements performed on individual units of the object being tested are compared with the average of signals obtained through measurements performed on a preselected number of units of acceptable quality. The state of operability of the test apparatus may be self-checked during incremental periods between the testing of units.

29 Claims, 8 Drawing Figures

PACKAGING QUALITY CONTROL METHOD AND APPARATUS

BACKGROUND OF THE INVENTION (1) Field of the Invention

The present invention relates to the exercise of quality control over a packaging process and particularly to the non-destructive testing of the degree of filling of cigarette papers and packages. More specifically, this invention is directed to optical test apparatus and especially to reflectivity measuring devices for testing the degree of filling of cigarettes and the completeness of blocks of cigarettes which are to be wrapped as individual packages. Accordingly, the general objects of the present invention are to provide novel and improved methods and apparatus of such character.

(2) Description of the Prior Art

Optical test apparatus for use in the measurement of the degree of filling of cigarette papers are well known in the art. One such prior art device is shown in U.S. Pat. No. 4,267,444 which is assigned to the assignee of the present invention. In the appartus of this patent a transceiver has its light emission and collection surfaces arranged transversely to the axes of the cigarettes to be tested, these surfaces being separated from one another by a neutral zone. The emission and collection surfaces cooperate with a fiber optic plate on which the cigarette ends are brought to rest. The light emitted by the test apparatus is transmitted to the cigarettes and, after multiple reflections in the region of each cigarette, a portion of the emitted light will impinge upon a collector. Due to losses along the light path, the intensity of the light received at the collector is greatly reduced when compared to the emitted light. The intensity of the light received by the collector is inversely proportional to the number of the tobacco fibers which are present. Accordingly, if a pre-selected threshold value of received light intensity is exceeded, the cigarette under test is taken to be a reject. Apparatus of this type has the disadvantages of being technically complex and relying upon a low level signal as an indication of an acceptable product. Since the collector may see stray light, and the surface on which the cigarettes are supported during testing may become soiled, use of a low level signal as an indication of an acceptable product is very disadvantageous.

It is also to be observed that the apparatus of the aforementioned German patent is characterized by output signals from the photocells of the collectors which rise to a peak value at an intermediate point along a plot of distance versus reflected light intensity and then decrease. Accordingly, the signals provided by the collectors are subject to ambiguity. For example, if the end of a cigarette in a block is spaced a relatively great distance from the testing head as a result of breakage, the reflected signal will lie on the decreasing side of the illumination curve and may be within the range which is indicative of an acceptable cigarette.

For a further description of the prior art, reference may be had to application Ser. No. 444,315 entitled "Mechanism for the Testing of the Degree of Filling of Cigarette Ends" which has been filed contemporaneously with this application.

SUMMARY OF THE INVENTION

The present invention overcomes the above-discussed and other deficiencies and disadvantages of the prior art by providing a novel and improved non-destructive optical technique for sensing the degree of filling of cigarettes, and other similar wrapped products, and apparatus for use in the practice of the said method. Apparatus in accordance with the invention is responsive to light reflected from the test object or objects and, in accordance with the preferred embodiment, utilizes standard reflection photocells which comprise light-emitting diodes and phototransistors arranged side-by-side with their active surfaces lying in the same plane.

Also in accordance with a preferred embodiment, the present invention provides compensation for the influence of stray or ambient light. Further, the present invention may be provided with means for self-testing which will be activated during intervals of the operational cycle when a product is not being tested.

BRIEF DESCRIPTION OF THE DRAWINGS

The present invention may be better undrstood and its numerous objects and advantages will become apparent to those skilled in the art by reference to the accompanying drawing wherein like reference numerals refer to like elements in the several figures and in which.

DESCRIPTION OF THE DISCLOSED EMBODIMENT

Figure 1:
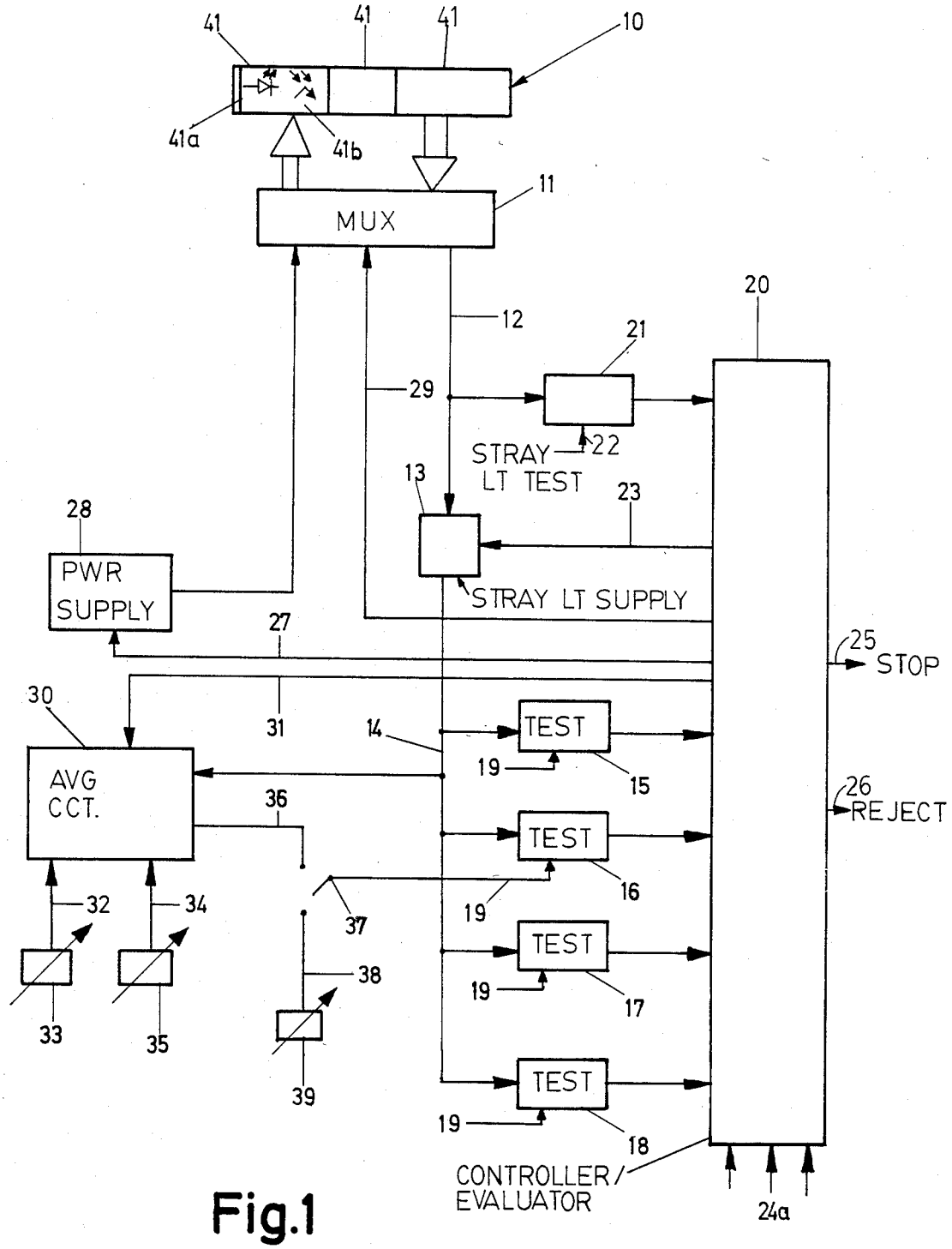
FIG. 1 is a functional block diagram of a cigarette testing apparatus in accordance with the present invention.
Figure 2:
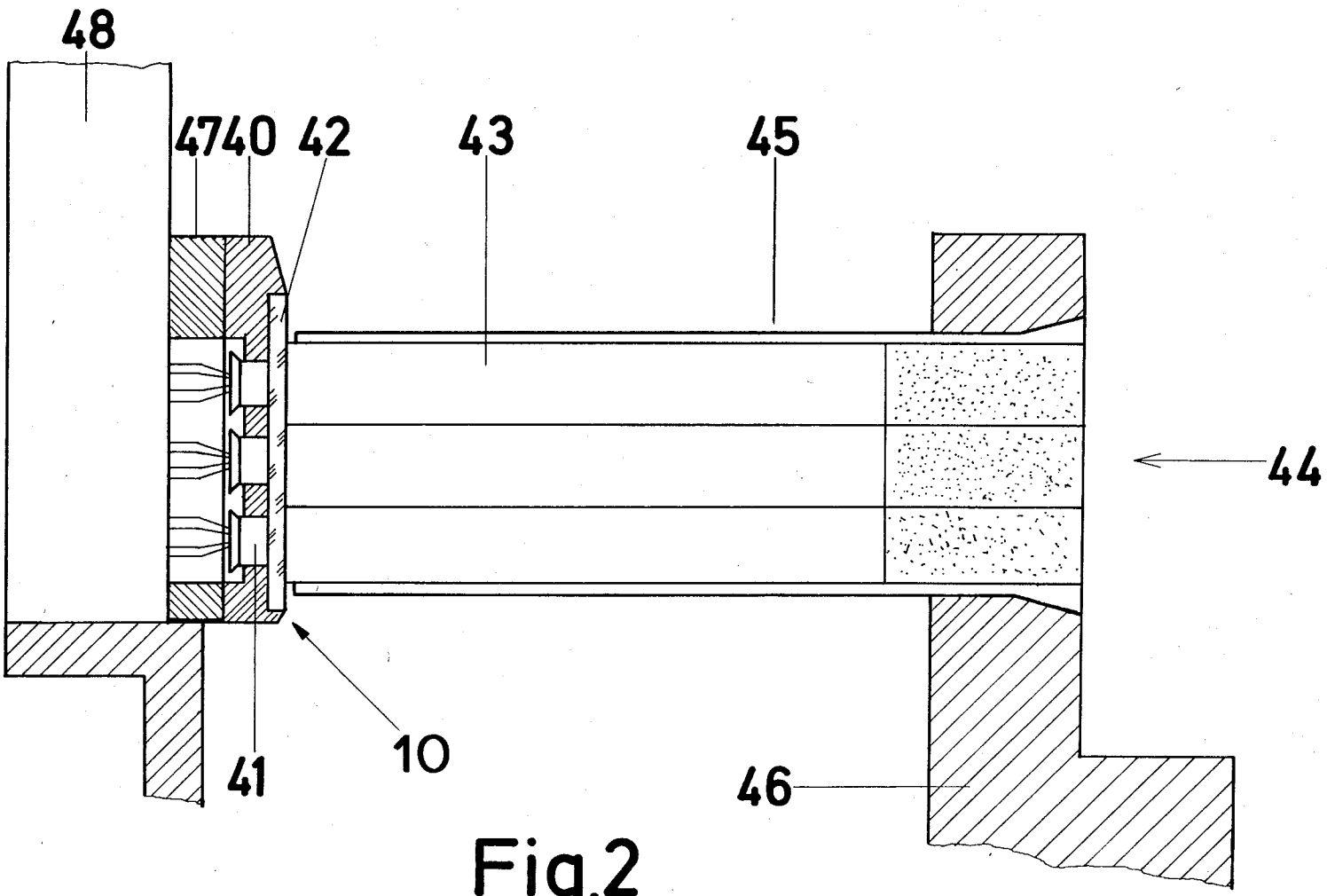
FIG. 2 is a cross-sectional schematic view of a test head for use in the apparatus of FIG. 1.

With reference to FIG. 1, a cigarette block testing apparatus in accordance with the present invention, comprises a test head 10 which may be in the form depicted in FIG. 2. Electrical signals for operating head 10 and signals commensurate with the reflected light incident upon the sensors of head 10 are passed through a multiplexer 11. Multiplexer 11, as will be described in more detail below, operates under the control of a controller/evaluator 20, the control signals for multiplexer 11 being delivered thereto via conductor 29. The controller/evaluator 20 may, for example, comprise a suitably programmed digital computer. The information bearing signals corresponding to the light incident upon the sensors of head 10, when passed by multiplexer 11, are delivered via conductor 12 to a stray light suppression circuit 13. The information bearing signals are also applied as an input to a stray light testing circuit 21. After compensation for the effects of stray light in suppression circuit 13, the information bearing signals are simultaneously delivered, via conductor 14, to parallel connected testing circuits 15, 16, 17 and 18. These test circuits respectively test for missing cigarettes, damaged or otherwise unacceptable cigarettes, whether the background reflection exceeds an upper limit and whether the background reflection falls below a lower limit. The inputs for the threshold levels, i.e., the bias signals, against which the information bearing inputs to the four testing circuits are compared are all identified by reference numeral 19. The output signals provided by testing circuits 15, 16, 17 and 18 are delivered as inputs to the control/evaluation device 20.

The control/evaluation device 20 receives, as an additional input, the output of stray light testing circuit 21 which has a bias or threshold input as indicated at 22. In addition to controlling multiplexer 11, the control-/evaluation device 20 provides a control signal, on conductor number 23, for the stray light suppression circuit 13.

The control/evaluation device 20 has a plurality of further inputs 24*a* which include status signals provided by the machine, for example a cigarette packaging machine, which causes the product to be tested to be transported to the test head 10. Thus, by way of example, in the case of a cigarette packaging machine having a revolving table with cigarette block receiving cells, the control/evaluation device 20 will receive input signals 24*a* indicative of the angular positioning of the cells.

Device 20 provides a "stop" output 25 which will typically be employed to cause a shut-down of the packaging machinery. Device 20 also has an output 26 which may be employed to cause the ejection of a tested cigarette block which has produced sub-standard readings. Device 20 has a further output, applied to conductor 27, which controls the power source 28 for head 10. The power source 28 will typically be a pulsed direct current supply for energizing the light emitters of head 10, these energizing signals being delivered to the light emitting diodes or other light emitters of head 10 by multiplexer 11 in the appropriate sequence. Additional outputs of device 20 comprises control signals, applied to the conductor of a cable 31, for an averaging circuit 30.

The averaging circuit 30, in addition to the control inputs from device 20, receives the information bearing signals on conductor 14. A further input to averaging circuit 30, supplied thereto by conductor 32, is an analog signal which is selected, through the use of potentiometer 33, to be commensurate with the number of cigarettes to be used in forming the average. Also, via conductor 34, an analog input, selected by means of potentiometer 35, commensurate with a desired rejection rate can be delivered to averaging circuit 30. The output 36 of averaging circuit 30 is delivered, via a switch 37, as the biasing input to testing circuit 16. Switch 37 may be used to select either the output of averaging circuit 30 or a fixed average value as selected by means of potentiometer 39 and applied to conductor 38.

Figure 3:
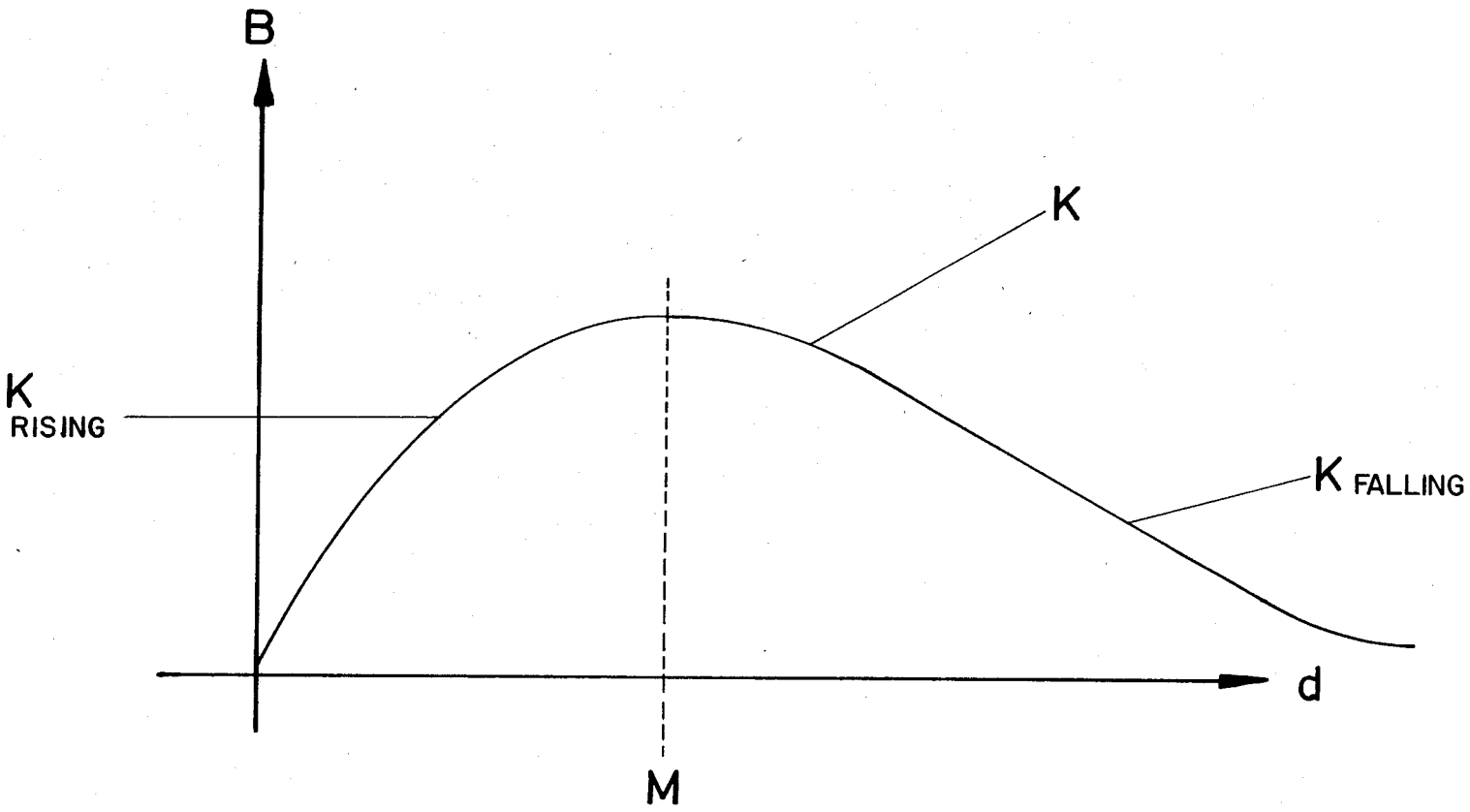
FIG. 3 is a graphical representation of the intensity of the light reflected from a cigarette end as a function of the distance of the end from the light emitter-sensor of the test head of FIG. 2.

The testing head 10 in accordance with a preferred embodiment will now be briefly described by reference to FIGS. 2 and 3. For a more complete description of the testing head, reference may be had to above-referenced contemporaneously filed application Ser. No. 444,315. The test head 10 includes a mounting plate 40 provided with an array of apertures. Reflection photocells 41, which are comparatively inexpensive state-of-art devices, are inserted in each of the apertures in plate 40 as shown. The reflection photocells 41 each comprise a light emitting diode, which functions as a light source, and a phototransistor. The LED and phototransistor are mounted such their respective light emission and collection surfaces are coplanar.

A glass plate 42 is positioned at the front of mounting plate 40 so as to be parallel with the plane defined by the active surfaces of the reflection photocells. The distance between the exposed surface of glass plate 42 and the photocells, i.e., the thickness of plate 42, is selected such that, upon the positioning of cigarettes or other objects to be tested on plate 42, the phototransistors will receive sufficient reflected light to generate a signal having a magnitude which is both sufficiently great to be compared with a threshold value and which will decrease if the test object is substandard. Restated, and referring to FIG. 3, the thickness of plate 42 is such that the distance d of the end of a cigarette 43 from the phototransister of a reflection photo cell 41 is greater than M. This arrangement insures that the output signals of the sensors will be a direct function of the degree of filling of the cigarettes being tested, i.e., the maximum output signal produced by the phototransistors will be commensurate with an acceptable product, and precludes operation on the rising portion of the intensity versus distance curve.

Continuing to discuss FIG. 2, the test head 10 will typically cooperate with a rotary table 46 which has cells 45 for receiving blocks of cigarettes 43, a cigarette block being indicated generally at 44. The head includes additional support structure, indicated at 47, which interfaces with a printed circuit board 48 whereby the energizing signals for the LEDs and the signals commensurate with the light incident upon the phototransistors are delivered to the multiplexer 11 of FIG. 1. A feed mechanism, not shown, will be employed to establish contact between the glass plate 42 and the ends of the cigarettes 43 comprising block 44 after each step of the rotary table 46.

Figure 4:
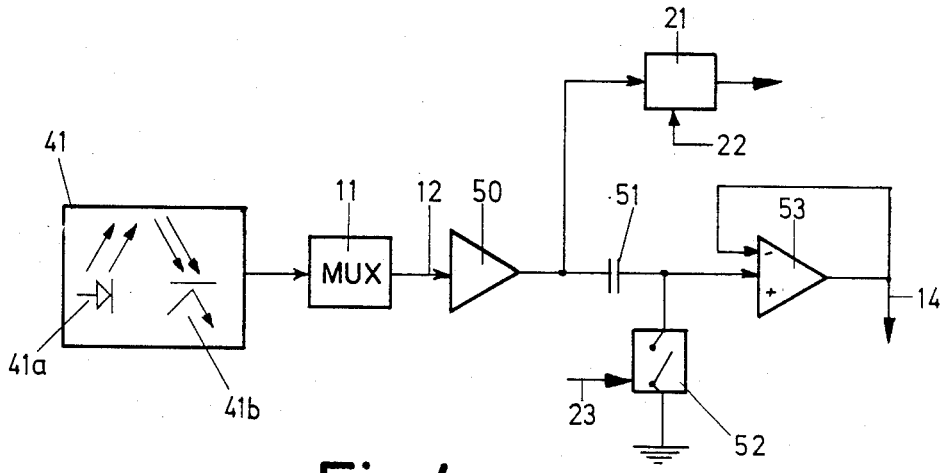
FIG. 4 is a functional block diagram of the stray light suppression circuit of the apparatus of FIG. 1.
Figure 5:
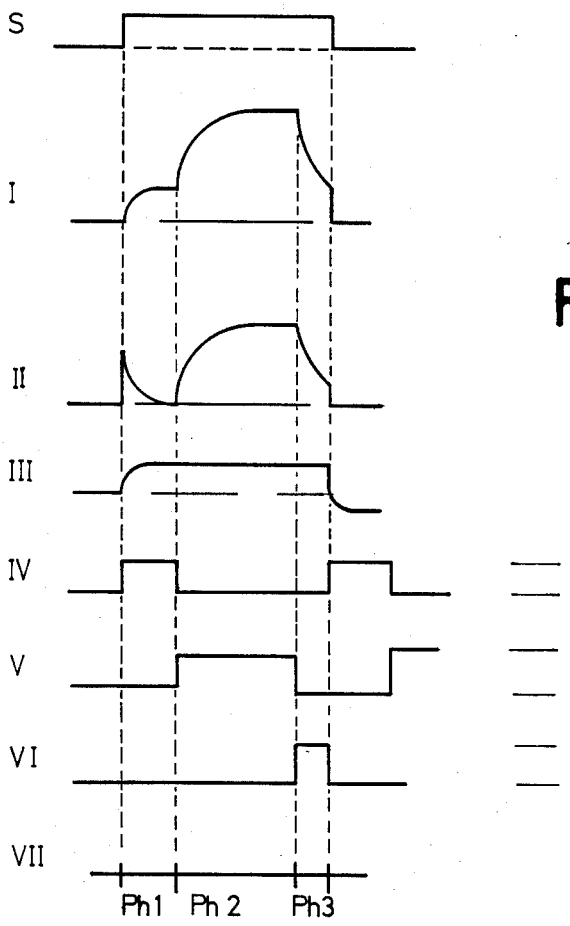
FIG. 5 is a graphical representation, in the form of a timing diagram, which represents the operation of the circuit of FIG. 4.

The structure and operation of a stray light suppression circuit 13, suitable for use in the apparatus of FIG. 1, may be seen and understood by simultaneous consideration of FIGS. 4 and 5. The scanning of each of the reflection photocells 41 of test head 10 comprises a three phase procedure. In the first phase, indicated as Ph 1 in FIG. 5, the LED, represented at 41*a* in FIGS. 1 and 4, is unenergized. During this period of time the phototransistor, represented at 41*b* in FIGS. 1 and 4, sees the background or stray light and produces an output signal SF. This SF, or stray light fraction, signal is stored as an analog value. The LED 41*a* is energized during the second phase Ph 2 of the scanning cycle. During the portion of the cycle when the LED is emitting light the phototransistor 41*b* will produce an output signal SL commensurate with the sum of the light emitted by the LED and reflected from the object under test and the stray light. The intensity of the light reflected from the end of the cigarette or other object being tested, SR, may be computed by subtracting the stored SF signal from the SL signal. During the third phase of the scanning cycle the LED 41*a* is deenergized and thus the multiplexer 11 can be switched in the absence of current. During the third phase, indicated at Ph 3 on FIG. 5, the outputs of the testing circuits 15 through 18 are sampled and evaluated in control/evaluator 20.

Continuing to refer to FIG. 4, the electrical output signal provided by the phototransistor 41*b* is delivered, by multiplexer 11 to a pre-amplifier 50. Amplifier 50 provides an output signal of the appropriate polarity and magnitude for charging a capacitor 51, a first plate of capacitor 51 being connected to the amplifier output. The second plate of capacitor 51 maybe connected to ground via a switch 52. Switch 52 is controlled, via conductor 23 by the output of control/evaluator circuit 20, so as to be in the closed state during the first phase Ph 1 of the reflection photocell scanning cycle. Accordingly, capacitor 51 will charge to the level SF commensurate with the stray light. During the second phase Ph 2 of the scanning cycle, when the actual reflectivity measurement occurs and the LED 41*a* is in the energized state, the switch 52, which is preferable an analog type switch, becomes a high resistance. The second plate of capacitor 51 is connected as the first input to a further amplifier 53 which is connected as a voltage follower and has a very high input impedance. Accordingly, during the second phase Ph 2 of the scanning cycle, the charge on capacitor 51 cannot significantly vary from level SF. At the start of the second phase Ph 2 the output voltage of amplifier 53 is always zero while the output voltage of pre-amplifier 50 corresponds to the stray light signal SF. During the second phase Ph 2 of the scanning cycle, the voltage at the output of amplifier 50 increases by an amount corresponding to the additional, i.e., the reflected, light received by the phototransistor due to the energization of the LED. Since the voltage at the input to amplifier 53 was zero at the start of the second phase Ph 2, this input voltage will increase to a level SR which corresponds only to the light from the LED which is reflected to the phototransister, i.e., the voltage SF stored in capacitor 51 and corresponding to the stray light is subtracted from the received and amplified total signal SL appearing at the output of amplifier 50. The duration of the second phase Ph 2 of the scanning cycle must be sufficiently long to take into account the delays in the response time of the light emitter and light sensor of the test head.

Referring to FIG. 5, the above-described operation of the stray light suppression circuit is represented by means of wave form diagrams. In FIG. 5 the duration of the scanning cycle, as defined at multiplexer 11, is indicated at S. A voltage which would typically appear at the output of amplifier 50 is indicated by I, the voltage appearing at the input of amplifier 53 is indicated at II, while the charge on capacitor 51 is indicated at III. The state of switch 52, i.e., closed or open, is indicated at IV while the state of energization of LED 41*a* is represented at V. The evaluation time, i.e., the time during which the outputs of the test circuits 15 through 18 are sampled by control/evaluator 20, is indicated at VI.

The stray light test circuit 21 compares the stray light signal SF, which appears at the output of amplifier 50 during phase Ph 1, with a prescribed limit value which may, for example, be set by means of a potentiometer. The threshold value signal is delivered to input 22 of stray light test circuit 21. If the stray light level becomes so great that it threatens to saturate the sensor 41*b*, the control/evaluation device 20, which is connected to the output of the stray light test circuit 21, will provide a "stop" signal at its output 25. It will be understood that the output of stray light test circuit 21 will be evaluated only during phase Ph 1 of the scanning cycle.

The output signal of the stray light suppression circuit 13, i.e., the information bearing signals applied to conductor 14, are compared in test circuit 16 with a threshold level signal generated in the manner to be described below. If the signal on conductor 14 falls below this threshold value for one or more cigarettes of a cigarette block, the control/evaluation device 20 will produce an output 26 which causes the block to be rejected as being below the production quality standard. If one or more cigarettes are missing from a cigarette block under test, the light reflected to the corresponding sensors 41*b* will be significantly lower than would be the case for a sub-standard cigarette even if neighboring cigarettes partially cover the space above the sensor by displacement in the block. The threshold or bias signal applied at input 19 of test circuit 15 is significantly lower than the threshold signal delivered to test circuit 16. Accordingly, test circuit 15 will detect spaces within a cigarette block where a cigarette is absent. If a preset number of cigarettes in the block are missing as established by the comparison of the outputs of test circuits 15 and 16 by the control/evaluation device 20, both stop and reject signals will be provided on respective of outputs 25 and 26 of device 20.

The test circuits 17 and 18 serve to check the operational status of the testing apparatus. In performing this self-monitoring, the background reflection resulting from the interpositioning of the transparent plate 42 in front of the reflection photocells 41, with no reflecting objects present, is employed. This background reflection is normally quite small and will vary as a function of the nature and degree of any soiling of the test object contacting surface of plate 24. The background reflection will, of course, be measured during the times in which no cigarettes or other test objects are in place in front of the testing head 10.

If the background reflection increases above a prescribed upper threshold, as determined by the bias applied at input 19 of test circuit 17, a "stop" condition is presented since defective cigarettes could be recognized as being acceptable. Conversely, if the background reflection falls below a prescribed lower threshold, commensurate with the bias applied at input 19 of test circuit 18, soiling of the plate 42 or a component failure in the apparatus is indicated. The test circuits 17 and 18 function as comparators to produce output signals which are recognized by the control/evaluation device 20 and which will result in the generation of a stop signal. As should be obvious, the circuits 17 and 18 will recognize a reflection photocell failure, the reflection photocells preferably being checked after each measurement. As described above, the control/evaluation device 20 may produce a stop signal for any one of several reasons. It is thus desirable to provide an indicator which stores and displays the cause of the most recent stoppage. Before each new restart of the packaging line, these stop indicators must be cleared by means of a reset input 24*a* to device 20.

The embodiment of FIG. 1 employs a two-fold multiplexer, i.e., one multiplexer section for each reflection photocell LED and phototransistor, which is operated synchronously. As an alternative, a simple multiplexer which connects each of the reflection photocells to the power supply 28 by means of a switch device may be employed. It is particularly advantageous for the multiplexer 11 to be switched without current flow during the third phase Ph 3 of the sampling of a reflection photocell.

Figure 6:
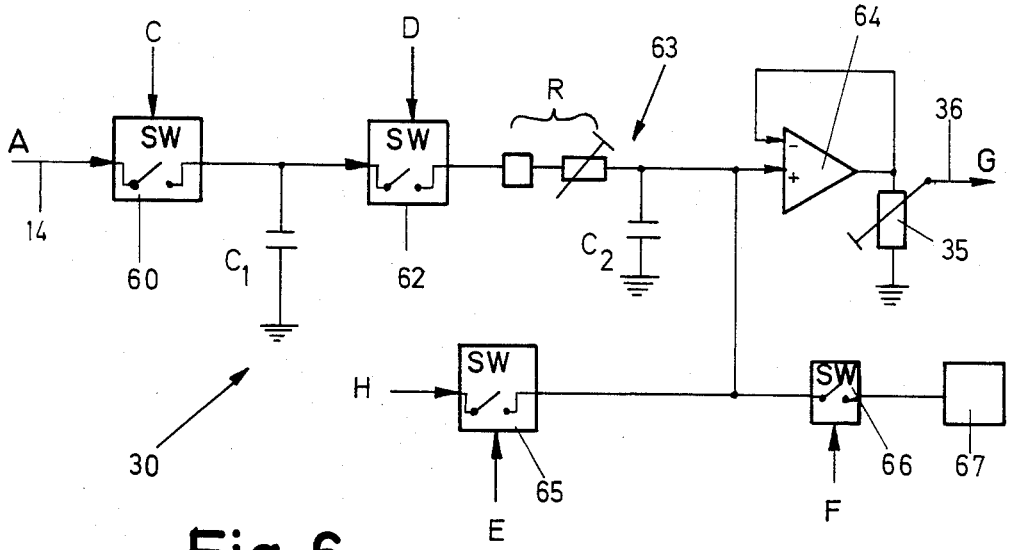
FIG. 6 is a functional block diagram of an averaging circuit which may be employed in the apparatus of FIG. 1.

FIG. 6 depicts, in block diagram form, an averaging circuit 30 which may be employed in the embodiment of FIG. 1. The averaging circuit comprises a first switch 60 having a first input A directly connected to conductor 14 and a second, i.e., control, input C which is connected via conductor 31 to the control/evaluation device 20. Thus, input A of switch 60 receives an analog voltage commensurate with the quality of the cigarette currently being tested. Switch 60 will be caused to be in the open condition during the last 3/5ths of the sampling period of the output of any of the reflection photocells 41. The output of switch 60 is connected to the first plate of a capacitor C1 and to the signal input of a second similar switch 62. A control signal D is applied to switch 62 from control/evaluation device 20 via one of the conductors of cable 31. The control mode causes switch 62 to be operated to the open state for a preselected time when the testing of a cigarette is completed and the cigarette has been found to be good as indicated by the output of test circuit 16. The output of switch 62 is connected to an RC circuit 63 comprising a variable resistance R and a capacitor C2. The signal appearing at the junction of the resistance R and capacitor C2 is applied as an input to an operational amplifier 64 connected as a voltage follower.

The averaging circuit 30 further comprises a third switch 65 which receives an input analog voltage H. The voltage H will be a preselected average value which is employed upon apparatus start-up. The control input E to switch 65 is also provided, via one of the conductors of cable 31, by the control/evaluation device 20. Switch 65 is operated in such a manner that it will be opened for a short time after the application of the operational voltage to the system by means of a master reset impulse.

A further switch 66 is connected between the output of a constant current source 67 and the output of switch 65. Switch 66 also receives its control input F from device 20 via one of the conductors of cable 31. Switch 66 is opened for a preselected time period when a cigarette being tested has been found to be defective as indicated by the output of test circuit 16. The outputs of switches 65 and 66 are connected to capacitor C2 and the input to operational amplifier 64. Accordingly, the opening of switch 66 in the presence of a defective cigarette will cause capacitor C2 to be discharged by the constant current source 67 by a small, but constant, amount.

The averaging circuit 30 produces a signal, indicated in FIG. 5 as G, which represents the threshold value to be applied to the input 19 of test circuit 16. The signal G comprises an average value and a rejection rate.

The averaging occurs as follows: During the last part of any measurement, while an LED of a reflection photocell is in the light emitting state, the capacitor C1 is connected via switch 60 to the output of amplifier 53 (FIG. 4). Capacitor C1 is thus charged to a voltage level which corresponds to the quality of the cigarette currently being tested. The voltage on capacitor C2 corresponds to an average value and is preset upon start-up of the apparatus by the signal H. If, after evaluation of the measurement, the cigarette under test is found to be acceptable, the switch 62 will be opened for a preselected time period. During the time switch 62 is in the open condition, the average value, i.e., the charge on capacitor C2, is brought closer to the measured voltage as represented by the charge on capacitor C1, by a small portion of the difference between the voltages on capacitors C2 and C1. This adjustable time fraction allows determination of the influence which each individual cigarette found to be good has on the average value.

The proportion to which an individual measurement value enters into the average value is given by the following formula:

$$\frac{\Delta U_2}{U_1 - U_{2old}} = \frac{C_1}{C_1 + C_2}\left(1 - e^{R\frac{-\frac{T}{C1\cdot C2}}{C1+C2}}\right) \quad (1)$$

where $U_1$ is the measurement value, $U_{2old}$ is the old average valuebefore alteration by $U_1$, $\Delta U_2$ is the fraction to which the average value approaches the measurement value $U_1$, and $U_1 - U_{2old}$ is the difference between the average value and the measured value. In order to obtain an approximately linear relationship between the proportion to which the measured value modifies the average value, and a variation of the resistance R, the opening time T of switch 62 must be much smaller than the time constant $\tau_{res}$. Thus, $$\frac{\Delta U_2}{U_1 - U_{2old}} \sim \approx \frac{1}{R}. \quad (2)$$

for $T << \tau_{res}$. This averaging corresponds to an arithmetic averaging in which each new value modifies the average by a constant factor.

From the relation for the resulting time constant:

$$\tau_{res} = R\frac{C_1 \cdot C_2}{C_1 + C_2} \quad (3)$$

the greatest time for the smallest capacitance is when C1=C2. Then the equation for the average value factor simplifies to:

$$\frac{\Delta U_2}{U_1 - U_{2old}} = \tfrac{1}{2}\left(1 - e^{-\frac{2T}{RC}}\right) \quad (4)$$

for C1=C2=C.

Continuing with the above discussion, and considering the example where a ratio 1:100 is set by means of the resistance R, i.e., averaging over every one hundred cigarettes, it is desirable that the first one hundred cigarettes to be tested not be considered in determining the average. Accordingly, it is necessary to count the tested cigarettes by means of a counter and, if the averaging ratio is to be changed, both the resistance R and the counter will have to be adjusted. In order to measure these two values correctly with a single input, the resistance R may be controlled by a digital counter. However, in order to enable the average value to be exactly determined beginning with the second cigarette tested, a resistance network and associated digital-to-analog converter controlled by a counter can be employed in place of variable resistance R. This alternate arrangement is depicted in FIG. 7 and will be described below.

Figure 7:
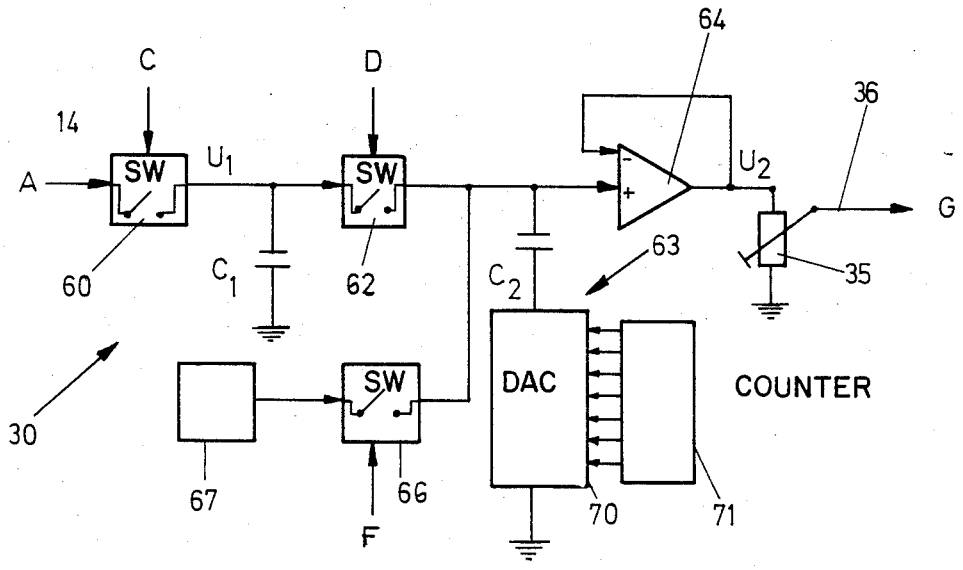
FIG. 7 is a functional block diagram of an alternate averaging circuit for use in the apparatus of FIG. 1.

Referring to FIG. 7, during the testing of a first cigarette the switches 60 and 62 are both set to the open state. The resistance network, which is in the form of a R-2R network of the digital-to-analog converter 70, will be set to zero ohms by counter 71. Both of capacitors C1 and C2 are charged to the first measurement value. While a second cigarette is being tested only switch 60 will be opened and capacitor C1 will thus be charged to the second measurement value. If the second cigarette is found to be good, switch 62 will be opened. At this time the resistance network will still have the value of zero ohms. An average value, corresponding to the first two measurements, will be commensurate with the charge on capacitor C2 since:

$$U_{2(2)} = U_{2(1)} + \frac{U_{1(2)} - U_{2(1)}}{2} \quad (5)$$

The index in parenthesis indicates the number of the measurement. In the first measurement, $U_{1(1)}=U_{2(1)}$. In the second measurement the factor $$\frac{\Delta U_{2(2)}}{U_{1(2)} - U_{2(1)}} = \tfrac{1}{2} \quad (6)$$

In the averaging with the third measurement value, the R-2R network is stepped to its smallest resistance value. This smallest resistance value will reduce the averaging factor to $\frac{1}{3}$ so that, after n measurements:

$$U_{2(n)} = U_{2(n+1)} + \frac{U_{1(n)} - U_{2(n-1)}}{n} \quad (7)$$

The averaging will be limited to a preselected number n since no useful purpose is served by forming an average over an indefinite number of measurements. Thus, if for example an average value over a hundred cigarettes is intended, the counter 71 is allowed to count to ninety eight and thereafter the resistance is held constant. Thus the averaging factor will be varied between 1/1 to 1/100 during the first one hundred measurements and will, accordingly, always form the actual average value (neglecting the error which arises as a result of the fact that for small ratio numbers the function $\Delta U_2=f(t)$ is less linear since it runs over a greater portion of the small e-function). All measurements after the 101st have a constant averaging factor of 1/100.

Figure 8:
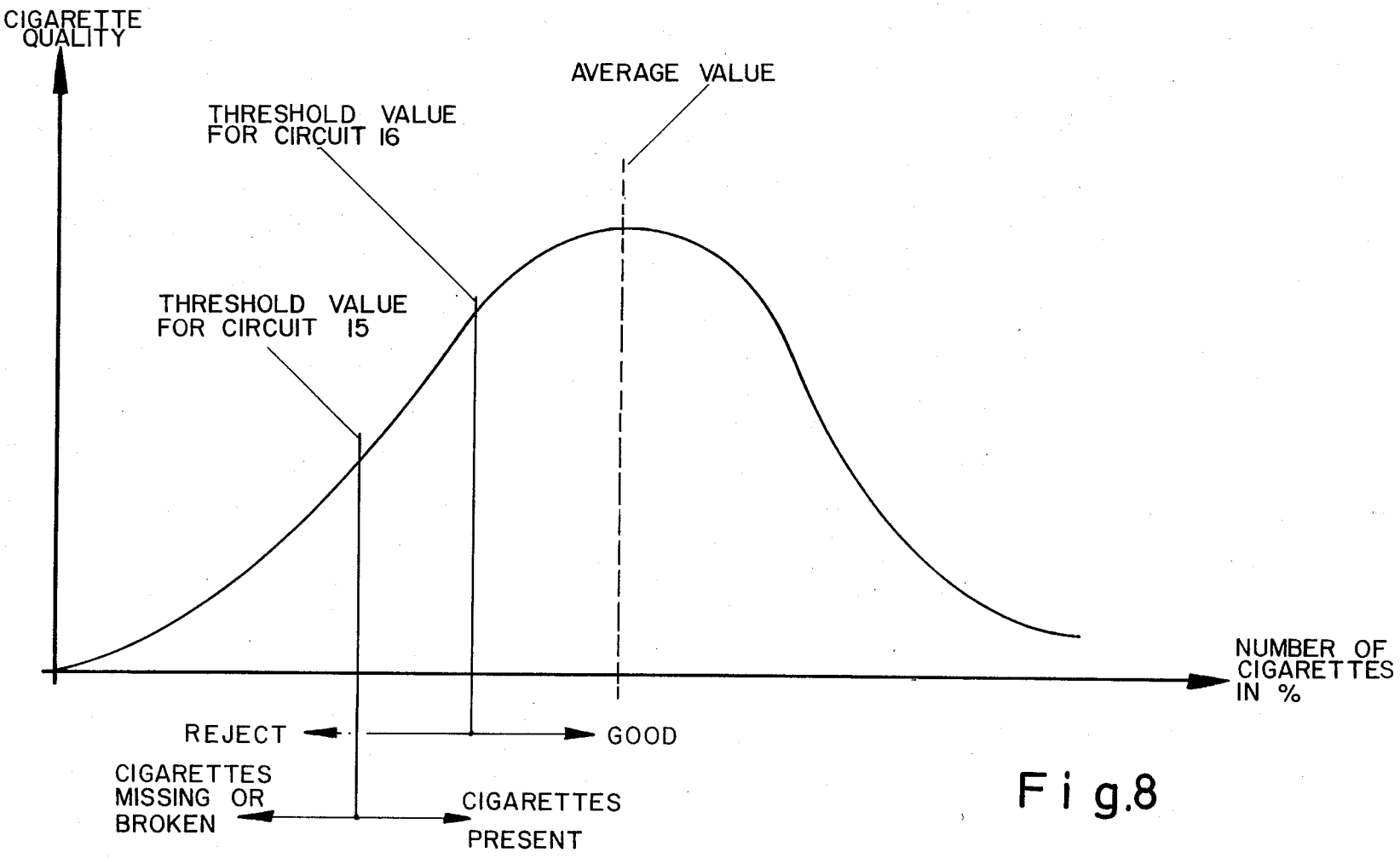
FIG. 8 is a graph depicting the statistical distribution of cigarette quality versus number of cigarettes in percent.

If cigarettes recognized as "bad" do not influence the averaging, the average value will fall to the right of the maximum of the statistical distribution of measurement values, as represented in FIG. 8, whereby the average value is also influenced by the rejection rate selection potentiometer 35 (provided the the rejection rate is set to be greater than zero). This operational condition is normally satisfactory. However, with a rejection rate set high, and with a sudden variation in tobacco coloration toward a darker shade, all cigarettes could be recognized as "bad" since the reflection from the ends thereof will decrease. Under these conditions no additional measurement values could influence the average and thus the average could not be adapted to the new color of the tobacco. In order to prevent such an undesired condition, those cigarettes recognized as "bad" can also be employed to influence the average value. This is accomplished, in the FIG. 7 embodiment, through the use of the constant current source 67 and switch 66 controlled by the signal F. Thus, whenever a cigarette is recognized as "bad" by test circuit 16, the switch 66 will be operated to the open state by the signal F for a constant, very short time. During this time a constant current having a polarity such that the average value is slightly lowered will flow in capacitor C2. Thus, any "bad" cigarette, but not broken or missing cigarettes, will reduce the average value by a small constant amount, which is adjustable regardless of the quality of the cigarette.

In the manner described above, the apparatus of the present invention will self-adjust to a new tobacco color which becomes so dark that at first the cigarettes are evaluated as "bad", but without the actual measurement values of those cigarettes which are recognized as "bad" being included in the averaging. The constant amount by which the average value is lowered in each step can be adjusted in constant current source 67. Since the value of the constant amount is related to the average value, and in the interest of avoiding a single "bad" cigarette having too great an influence on the average value, the increments by which the average value is changed will be small. For example, the increments may be commensurate with the influence on the average value by a "good" cigarette which lies slightly below the average value.

It should be recognized that, rather than testing cigarette blocks, the present invention may be employed for the testing of individual cigarettes in which case the "two-fold" multiplexer 11 will be replaced by the less complicated circuitry needed for a single input to and output channel from the test head.

In order to prevent a double background reflection from plate 42, which could lead to an unfavorable ratio of the signals of interest to the background or "ground" reflection level, the plate 42 is placed directly in front of the reflection photocells 41. If the background reflection is nevertheless too great, the plate 42 can be selected to produce a diffused reflection on the side facing the reflection photocells so that the proportion of light reflected from the glass surface, and forming the background reflection, is reduced. As will be obvious, the plate 42 must have a smooth surface surface, to minimize dirt contamination, and plate 42 may be slightly opaque rather than clear glass.

It is to be understood that the invention is not limited to the illustration described and shown herein, which is deemed to be merely illustrative of the best mode of carrying out the invention, and which is suceptible to modification as to form, size, arrangement of parts and details of operation. The invention rather is intended to encompass all such modifications which are within its scope and spirit as defined by the following claims.

What is claimed is:

1. In a process for testing the quality of a product by directing light produced by a light source to the product and measuring the reflectivity of the product, a first threshold value of reflectivity being compared with a signal commensurate with the actual measured reflectivity and the product being rejected if the actual reflectivity signal falls below the first threshold value, the improvement comprising the steps of:

positioning the product to be tested upon a light transmissive plate;

measuring the stray light passing through the light transmissive plate and being received by a reflected light sensor with the source of the light which is to be directed to the product in the unenergized state;

measuring the light passing through the light transmissive plate and being received by the reflected light sensor with the light source in the energized, light emitting condition and the light emitted thereby being directed through the light transmissive plate to illuminate the product;

subtracting the value of the measured stray light from the value of the light reflected from the product to obtain a measurement of the quality of the product;

comparing the measurement of quality with the first threshold value to determine if the product is acceptable;

measuring the background reflection from the light transmissive plate with the light source in the light emitting energized condition and no test product positioned on the plate;

establishing third and fourth threshold values respectively commensurate with insufficient and excessive background reflection; and comparing the measured background reflection with the third and fourth threshold values and terminating the testing process if the measured background reflection does not fall between the third and fourth threshold values.

2. The process of claim 1 further comprising:

establishing a fifth threshold value commensurate with the stray light;

comparing the actual stray light measurement with the fifth threshold value; and providing a stop command if the actual stray light exceeds the fifth threshold value.

3. A process of claim 1 wherein the product being tested is a cigarette being tested for the degree of filling of the paper thereof, said process further comprising:

establishing a second threshold value commensurate with a missing or broken cigarette; and comparing said second threshold value with the results of the subtraction.

4. The process of claim 3 further comprising:

establishing a fifth threshhold value commensurate with the stray light;

comparing the actual stray light measurement with the fifth threshhold value; and providing a stop command if the actual stray light exceeds the fifth threshhold value.

5. The process of claim 4 further comprising:

determining the average value of a preselected number of reflectivity measurements; and using the determined average value as the first threshold value.

6. The process of claim 5 wherein the average value is modified by an amount proportional to the number of measurements used in the formation of the average for each actual test wherein the reflectivity of the test object exceeds the first threshold value.

7. The process of claim 6 further comprising:

modifying the average value for each new reflectivity measurement wherein the measurement is below the first threshold value but above the second threshold value.

8. The process of claim 7 wherein the modification of the average value is accomplished in constant magnitude increments.

9. The process of claim 3 further comprising:

determining the average value of a preselected number of reflectivity measurements; and using the determined average value as the first threshold value.

10. The process of claim 9 wherein the average value is modified by an amount proportional to the number of measurements used in the formation of the average for each actual test wherein the reflectivity of the test object exceeds the first threshold value.

11. The process of claim 10 further comprising:

modifying the average value of each new reflectivity measurement wherein the measurement is below the first threshold value but above the second threshold value.

12. The process of claim 1 further comprising:

determining the average value of a preselected number of reflectivity measurements; and using the determined average value as the first threshold value.

13. The process of claim 12 wherein the average value is modified by an amount proportional to the number of measurements used in the formation of the average for each actual test wherein the reflectivity of the test object exceeds the first threshold value.

14. The process of claim 13 wherein the modification of the average value is accomplished in constant magnitude increments.

15. In apparatus for testing the degree of filling of cigarette ends with at least one reflection photocell, the photocell comprising a light emitter which functions as a source of illumination for the cigarette end to be tested and a light sensor which receives light reflected from the illuminated cigarette end and generates a signal commensurate therewith, the improvement comprising:

means response to a signal provided by the light sensor in the absence of a test cigarette when the light emitter is unenergized for storing a signal commensurate with the stray light level;

means responsive to the stray light signal and to a signal commensurate with the light reflected from a test cigarette for subtracting the stray light signal from the reflected light signal to provide an output signal representative of the quality of the illuminated cigarette;

means providing a first threshold signal commensurate with the reflectivity of a cigarette of acceptable quality;

first comparator means for comparing said first threshhold signal with said subtracting means output signal, said first comparator means generating a signal which is indicative of whether the tested cigarette is acceptable;

means responsive to a signal provided by the light sensor in the absence of a test cigarette when the light emitter is energized for generating a signal commensurate with the background reflection;

means providing a third threshold signal commensurate with insufficient background reflection;

means providing a fourth threshold signal commensurate with excessive background reflection; and second comparator means for comparing the signal commensurate with actual background reflection with said third and fourth threshold signals, said second comparator means generating a signal which will command a termination of testing if the signal commensurate with actual measured background reflection does not fall between the third and fourth threshold signals.

16. The apparatus of claim 15 wherein said first threshold signal generating means comprises:

means responsive to measurements performed on a preselected number of cigarette ends for computing a average value of the level of the reflectivity thereof.

17. The apparatus of claim 15 wherein a plurality of cigarettes, collected into a block, are tested and said apparatus includes a number of reflection photocells commensurate in number with the number of cigarettes in a block.

18. The apparatus of claim 17 wherein said photocells are mounted in a test head and each comprise a light emitter with a planar emitting surface and a light sensor with a planar collecting surface, the sensor being positioned such that its collecting surface is coplanar with said emitting surface, said head further comprising a light transmissive plate, said plate being positioned in front of said emitter and sensor and defining a test object supporting surface which is parallel to the plane of said emitting and collecting surfaces, light being transmitted through said plate to a test object and in part being reflected back through said plate to said sensor, the intensity of the light received at said collecting surface having a characteristic distance verses intensity curve which increases to a maximum and subsequently decreases, the optical characteristics of said plate being selected to cause the reflected light to be at a level which is at a point on said curve at least equal to the maximum when a paper filled to the desired degree is illuminated whereby the reflection from an insufficiently filled paper will be of a lower intensity.

19. The apparatus of claim 15 further comprising:

means for generating a second threshold signal commensurate with a preselected maximum level of stray light; and second means for comparing said second threshold signal with the measured stray light and generating an alarm signal when the actual stray light level exceeds the level commensurate with the second threshold.

20. The apparatus of claim 19 wherein said first threshold signal generating means comprises:

means responsive to measurements performed on a preselected number of cigarette ends for computing a average value of the level of the reflectivity thereof.

21. The apparatus of claim 20 wherein said means for computing an average reflectivity level comprises:

means for storing a analog signal commensurate with the average level; and means for modifying the stored signal by each new measurement in a time fraction determined by the number of measurements used in determining the average.

22. The apparatus of claim 21 wherein said storing means includes a capacitor and wherein said apparatus further comprises a second capacitor whose charge corresponds to the respective measurement, the second capacitor being connected to said first capacitor during a period of time corresponding to the fraction of time corresponding to the prescribed number of measurements comprising the average.

23. The apparatus of claim 22 wherein said storing means further includes a constant current source and means for generating a fifth threshhold signal commensurate with the reflected light with the test cigarette broken, the charge on said first capacitor being reduced in increments determined by the current provided by the constant current source whenever the signal commensurate with the light reflected from a test cigarette is below said first threshhold signal and above said fifth threshhold signal.

24. The apparatus of claim 21 wherein each test of a cigarette comprises three phases and said apparatus further comprises:

controller means, said controller means including a source of power for the light emitter and multiplexer means, said controller means causing the light emitter to be deenergized during a first phase wherein the stray light is sensed by the light sensor, said controller means causing said light emitter to be energized during a second phase when the reflectivity of the cigarette end is sensed by the light sensor, and said controller means causing said light emitter to be deenergized during the third phase.

25. The apparatus of claim 24 wherein said modifying means is operative to modify the average value only when an acceptable cigarette has been tested.

26. The apparatus of claim 25 further comprises:

means for reducing the average value by constant increments when a cigarette having a reflectivity below the first threshold value has been tested.

27. The apparatus of claim 24 wherein a plurality of cigarettes, collected into a block, are tested and said apparatus includes a number of reflection photocells commensurate in number with the number of cigarettes in a block.

28. The apparatus of claim 27 wherein said controller means multiplexer means sequences the operation of said photocells.

29. The apparatus of claim 28 wherein said photocells are mounted in a test head and each comprise a light emitter with a planar emitting surface and a light sensor with a planar collecting surface, the sensor being positioned such that its collecting surface is coplanar with said emitting surface, said head further comprising a light transmissive plate, said plate being positioned in front of said emitter and sensor and defining a test object supporting surface which is parallel to the plane of said emitting and collecting surfaces, light being transmitted through said plate to a test object and in part being reflected back through said plate to said sensor, the intensity of the light received at said collecting surface having a characteristic distance verses intensity curve which increases to a maximum and subsequently decreases, the optical characteristics of said plate being selected to cause the reflected light to be at a level which is at a point on said curve at least equal to the maximum when a paper filled to the desired degree is illuminated whereby the reflection from an insufficiently filled paper will be of a lower intensity.

* * * * *